United States Patent [19]

Shiozaki et al.

[11] 4,280,837

[45] Jul. 28, 1981

[54] METHOD FOR CONTINUOUSLY CASTING SLAB FOR MANUFACTURING GRAIN-ORIENTED ELECTRICAL STEEL SHEET AND STRIP

[75] Inventors: Morio Shiozaki, Himejishi; Mitsuaki Kawashima; Yoshiaki Shimoyama, both of Kitakyusyushi; Nobuoki Ishihara, Nogatashi, all of Japan

[73] Assignee: Nippon Steel Corporation, Tokyo, Japan

[21] Appl. No.: 90,072

[22] Filed: Oct. 31, 1979

[51] Int. Cl.[3] ..... B22D 27/00

[52] U.S. Cl. ..... 75/54; 164/56; 164/82; 75/53; 75/58

[58] Field of Search ..... 164/56, 82, 57, 58, 164/55; 75/53-58, 123 L, 257

[56] References Cited

U.S. PATENT DOCUMENTS

| | | | |
|---|---|---|---|
| 3,876,476 | 4/1975 | Matsuoka et al. | 75/123 L X |
| 3,964,916 | 6/1976 | Armistead et al. | 164/82 X |
| 4,006,044 | 2/1977 | Oya et al. | 75/123 L X |

FOREIGN PATENT DOCUMENTS

| | | | |
|---|---|---|---|
| 2527553 | 12/1976 | Fed. Rep. of Germany | 164/82 |
| 50-64119 | 5/1975 | Japan | 164/56 |
| 52-66826 | 6/1977 | Japan | 164/82 |

*Primary Examiner*—Robert D. Baldwin
*Assistant Examiner*—K. Y. Lin
*Attorney, Agent, or Firm*—Wenderoth, Lind & Ponack

[57] ABSTRACT

In the continuous casting of slabs for use in manufacturing grain-oriented electrical steel sheet and strip, the slag covering the molten steel for casting the slabs is adjusted in its composition to maintain the ratio of $Al_2O_3$ to $SiO_2$ at not less than 0.25, whereby the slabs continuously cast from the molten steel are made free from variation in Al or Al and S content in the direction of casting.

4 Claims, 2 Drawing Figures

METHOD FOR CONTINUOUSLY CASTING SLAB FOR MANUFACTURING GRAIN-ORIENTED ELECTRICAL STEEL SHEET AND STRIP

BACKGROUND OF THE INVENTION

1. Field of the Invention

The present invention relates to a method for manufacturing continuously cast slab for use in the production of grain-oriented electrical steel sheet and strip, more particularly, to a method for manufacturing continuously cast slab for use in the production of grain-oriented steel sheet or strip containing not more than 4.0% of Si, 0.01–0.08% of Al and 0.01–0.06% of S, wherein the Al content or the Al content and the S content of the continuously cast slab does not vary in the direction of the continuous casting. As a consequence, in accordance with the method of the present invention, there is obtained a continuously cast slab which is substantially uniform in Al or Al and S content throughout its length. When this slab is used to produce grain-oriented electrical steel sheet or strip, the product obtained is free from any variation or degradation of its magnetic characteristics in the longitudinal direction as a result of variation in the Al or Al and S content thereof.

2. Description of the Prior Art

As is well known, the continuous casting method has numerous advantages over the conventional ingot casting method and, therefore, has been adopted for manufacturing slab for use in the production of electrical steel sheet and strip.

A problem arises, however, when grain-oriented electrical steel sheet and strip containing Al or Al and S are produced from continuously cast slab, as will be clear from the following.

When the slab is manufactured by the continuous casting method, the last of the molten metal used in the casting operation does not leave the ladle (or other vessel) in which it is contained until the casting is completed, and this may be for as long as one hundred minutes or more. In other words, a part of the molten steel used for casting remains in the ladle throughout the considerably long period of time during which the continuous casting process is carried out. When the molten steel containing Al or Al and S is retained in the ladle for a long period of time, the Al and the S in the molten steel react with the slag covering its surface, and as a result, Al and S are transferred into the slag as Al oxide and Ca sulphide and these cause local variation in the Al or Al and S content of the molten metal. Thus, when this molten metal having local variations in Al or Al and S content is cast into a slab, the slab obtained varies in Al or Al and S content in the direction of casting. If this slab is used to produce grain-oriented electrical steel sheet or strip, the product obtained will be highly unstable in its magnetic properties in the longitudinal direction. It has, therefore, been impossible to use continuously cast slab for industrially producing grain-oriented electrical steel sheet and strip of the type containing Al or Al and S having uniform magnetic characteristics in the longitudinal direction.

SUMMARY OF THE INVENTION

The object of the present invention is to provide a method for continuously casting slab for use in producing grain-oriented electrical steel sheet and strip having uniform magnetic characteristics in the longitudinal direction and, particularly, to provide a method for continuously casting slab having uniform Al or Al and S content in the direction of casting.

DETAILED DESCRIPTION OF THE INVENTION

Figure 1:
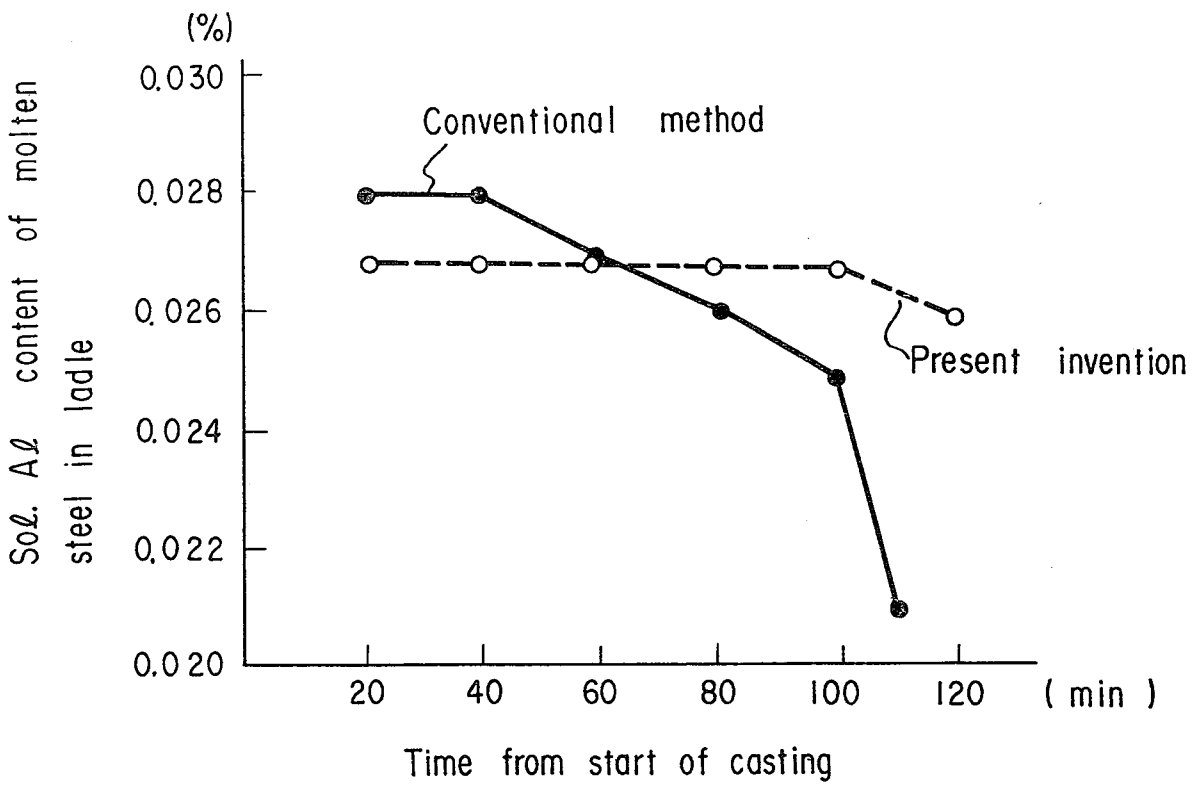
FIG. 1 is a graph showing the relationship in the continuous casting process between the Al content of a molten metal in a ladle (or other vessel) and the length of time from the start of the casting operation in the method according to the present invention and the conventional method.

It has already been mentioned that in carrying out the continuous casting method the molten metal used in the casting operation must, in part, be retained in a ladle or other vessle (referred to simply as a "ladle" hereinafter) for the long period of time required to complete the operation. If the molten metal contains Al, the Al reacts with the slag on the molten surface and is transferred into the slag as oxide. Thus, the Al content of the molten metal in the ladle comes to vary from place to place and to decrease as a whole with the passage of time. This is represented graphically in FIG. 1 which shows how the Al content of molten metal contained in a ladle decreases with time passed from the start of a continuous casting operation. The gradual decrease with time in the Al content of the molten metal results in a gradual decrease, in the direction of casting, in the Al content of the slab produced by continuous casting from the molten metal. Grain-oriented electrical steel sheet or strip produced from such a slab will therefore suffer from variation in its magnetic properties because of the variation in its Al content in the longitudinal direction.

Figure 2:
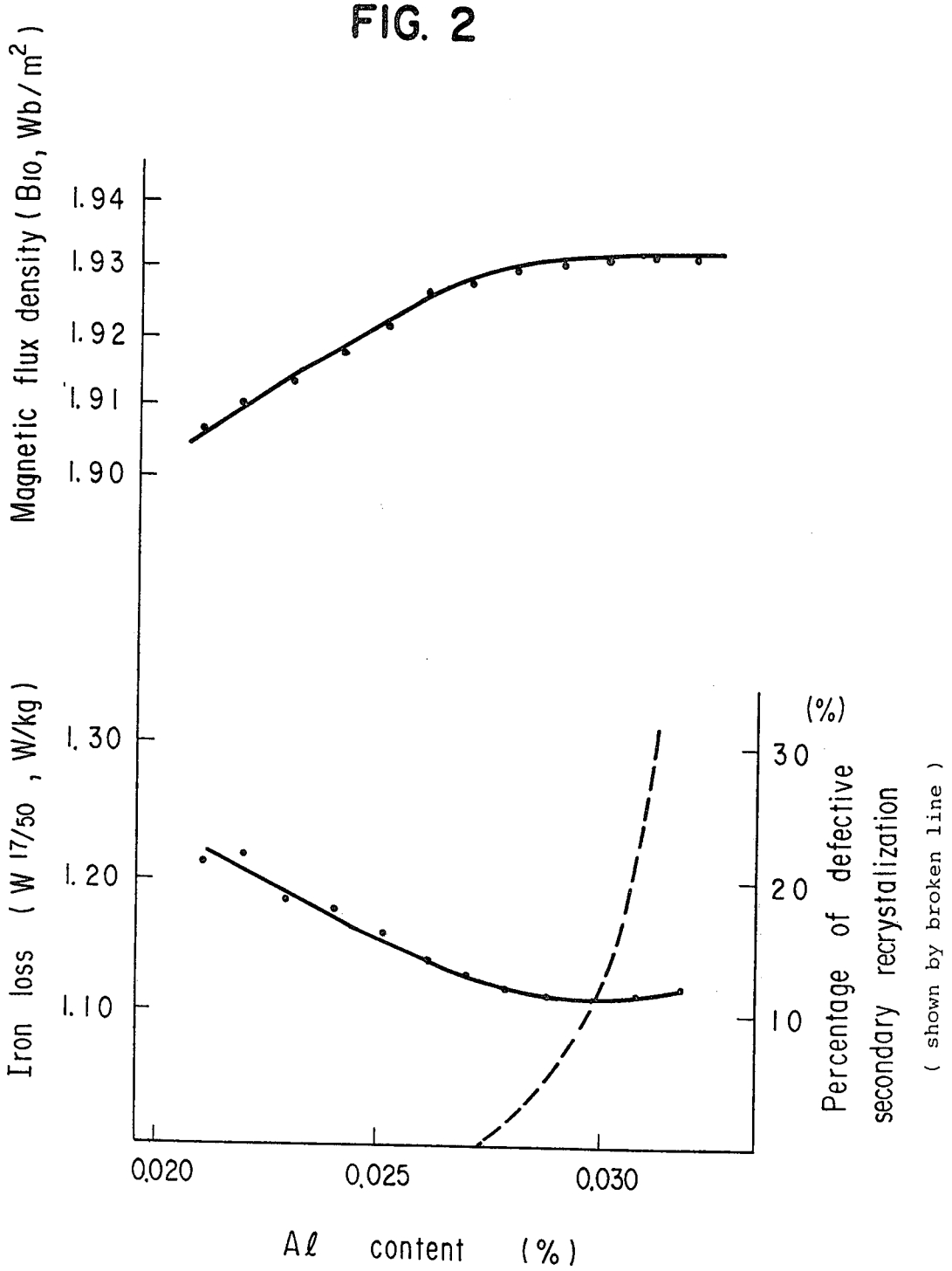
FIG. 2 is a graph showing the relationship between the Al content of a grain-oriented electrical steel sheet or strip and its magnetic properties.

FIG. 2 shows the effect of Al content on the magnetic characteristics of grain-oriented electrical steel sheet and strip. From this figure, it will be understood that non-uniformity in the Al content of steel sheet or strip in the longitudinal direction will cause non-uniformity in the magnetic characteristics thereof and that in order to obtain steel sheet and strip with uniform magnetic characteristics in the longitudinal direction, it is necessary to maintain the Al content of the molten metal in the ladle at the time of casting the slab from which the steel sheet or strip is produced at a constant value from the beginning to the completion of the casting operation.

The above described circumstances also apply in the case of the S content of the molten metal. Namely, the gradual decrease with time in the S content of the molten metal results in a gradual decrease, in the direction of the casting, in the S content of the continuously cast slab. The grain-oriented electrical steel sheet produced from such a slab therefore suffer from variation in its magnetic properties because of the variation in not only its Al content but also its S content in the longitudinal direction.

The inventors have discovered that in continuously casting a slab for use in producing grain-oriented electrical steel sheet and strip from molten metal containing not more than 4.0% of Si, 0.01–0.08% of Al and 0.01–0.06% of S, a slab having uniform Al content in the direction of casting can be continuously cast if, among the components of the slag covering the molten metal in the ladle (this slag being that accompanying the molten metal when it is transferred to the ladle from a steel-making furnace or a secondary steel-making furnace such as a vacuum degassing furnace, having CaO and other slag forming agents added thereto as required, being constituted mainly of 5–50% of CaO, 5–30% of $SiO_2$ and 1–30% of FeO and $Fe_2O_3$ [as total Fe] and containing small amounts of $Al_2O_3$, MgO, MnO, $P_2O_5$ etc.), the ratio of $Al_2O_3$ to $SiO_2$ ($Al_2O_3/SiO_2$) is maintained at 0.25 or more, preferably between 0.6 and 3.0, throughout the continuous casting operation. The ratio of $Al_2O_3$ to $SiO_2$ among the slag constituents is maintained at the aforementioned value by addition of $Al_2O_3$-containing material and/or $SiO_2$-containing material to slag. Although it is advantageous to make this addition at the time that the molten metal is transferred to the ladle, there is no restriction whatsoever on the time of the addition. As the $Al_2O_3$-containing material to be added, bauxite, particularly calcined bauxite, is preferable but other $Al_2O_3$-containing material such as powdered alumina can also be used. Silica can be advantageously used as the $SiO_2$-containing material but other $SiO_2$-containing materials can also be used without entailing any problems.

Moreover, it is possible to avoid a decrease in the Al and S content of the molten metal effectively, if in addition to maintaining the above mentioned ratio of $Al_2O_3/SiO_2$, the ratio of CaO to $SiO_2$ ($CaO/SiO_2$) is maintained at 0.25 or more, preferably between 0.6–2.0.

Moreover, depending on the circumstances, it is possible to avoid a decrease in the Al content of the molten metal even more effectively by additionally maintaining the ratio of $Al_2O_3$ to CaO in the slag components at not less than 1.0, preferably 1.0–2.0. As the source of CaO for this purpose it is possible to use calcined lime.

The molten metal transferred to a ladle and covered by slag adjusted, in accordance with the present method, is continuously cast into continuous casting mold via a conventional continuous casting tundish, thereby to produce a continuously cast slab. The slab obtained in this manner is free from variation in Al or Al and S content in the direction of casting and is substantially uniform throughout in its Al or Al and S content. After the slab has been cooled, it is cut into lengths appropriate for rolling and the cut lengths are used to produce grain-oriented electrical steel sheet or strip by the conventional method. The resulting product is possessed of uniform magnetic characteristics in the longitudinal direction of the steel strip.

It is possible by the method of the present invention to control not only the Al content of the molten metal but also the S content thereof.

The present invention will now be described in more detailed with reference to preferred embodiments.

EXAMPLE 1

100 tons of molten steel containing 0.047% C, 2.9% Si, 0.027% Al and 0.025% S, the balance being iron and unavoidable impurities, was transferred to a ladle from the converter in which it was produced. At this time, calcined bauxite was added at the rate of 5 kg per ton of steel to adjust the composition of the slag in the ladle to 16.50% CaO, 20.07% $SiO_2$, 55.85% $Al_2O_3$ and the remainder of other components. The ratio of $Al_2O_3$ to $SiO_2$ at this time was 2.78.

The molten steel covered by the slag of the above-mentioned composition was cast into a mold via a tundish to produce a continuously cast slab having a thickness of 200 mm. The time from start to completion of casting was 110 minutes.

The Al content as sol Al of the molten steel in the ladle at different times in the course of casting was as shown below in Table 1.

TABLE 1

| Time from start of casting (min.) | 20 | 40 | 60 | 80 | 105 | Immediately before completion of casting |
|---|---|---|---|---|---|---|
| Analyzed value of Sol Al (%) | 0.027 | 0.027 | 0.027 | 0.027 | 0.027 | 0.026 |

EXAMPLE 2

100 tons of molten steel containing 0.052% C, 3.2% Si, 0.028% Al and 0.024% S, the balance being iron and unavoidable impurities, was transferred to a ladle from the converter in which it was produced. At the same time, there were added to the ladle calcined bauxite at the rate of 2.8 kg per ton of steel and quicklime at the rate of 2.8 kg per ton of steel. By this addition, the composition of the slag in the ladle was adjusted to 32.12% CaO, 22.34% $SiO_2$ and 37.04% $Al_2O_3$, the remainder being other components. The ratio of $Al_2O_3$ to $SiO_2$ and the ratio of $Al_2O_3$ to CaO at this time were both 1.15.

The molten steel covered by the slag of the above-mentioned composition was cast into a mold via tundish to produce a continuously cast slab having a thickness of 200 mm. The time from start to completion of the casting was 110 minutes.

The Al content as sol Al of the molten steel in the ladle at different times in the course of casting was as shown below in Table 2.

TABLE 2

| Time from start of casting | 20 | 40 | 60 | 80 | 105 | Immediately before completion of casting |
|---|---|---|---|---|---|---|
| Analyzed value of Sol Al (%) | 0.028 | 0.027 | 0.028 | 0.027 | 0.026 | 0.027 |

EXAMPLE 3

100 tons of molten steel containing 0.045% C, 2.9% Si, 0.029% Al and 0.026% S, the balance being iron and unavoidable impurities, was transferred to a ladle from the converter in which it was produced. At the same time, calcined bauxite was added to the ladle at the rate of 5 kg per ton of steel to adjust the composition of the slag in the ladle to 28% CaO, 31% $SiO_2$, 32% $Al_2O_3$ and the remainder of 9% of other components. The ratio of $Al_2O_3$ to $SiO_2$ at this time was 1.0.

The molten steel cevered by the slag of the above-mentioned composition was cast into a mold via tundish to produce 11 continuously cast slabs of a thickness of 200 mm. The slabs were designated No. 1 through No. 11 in the order of their production.

Each of these slabs was heated to 1360° C. and rolled to obtain a 2.3 mm thick hot rolled steel sheet which was thereafter annealed at 1100° C. and then cold rolled to obtain a cold rolled steel sheet of 0.30 mm in thickness. This cold rolled sheet was annealed at 850° C. and then subjected to secondary recrystallization annealing at 1200° C. to obtain a grain-oriented electrical steel sheet.

The Al and S content of the eleven slabs and the magnetic characteristics in the longitudinal direction of the grain-oriented electrical sheet products obtained therefrom are shown below in Table 3.

TABLE 3

| Slab No. | 1-8 | 9 | 10 | 11 |
|---|---|---|---|---|
| Al content of hot rolled sheet | 0.029% | 0.028% | 0.029% | 0.029% |
| S content of hot rolled sheet | 0.026% | 0.026% | 0.026% | 0.026% |
| B10 of product | 1.93T | 1.93T | 1.92T | 1.92T |
| W17/50 of product | 1.10W/kg | 1.07W/kg | 1.08W/kg | 1.12W/kg |

COMPARATIVE EXAMPLE 100 tons of molten steel containing 0.047% C, 2.9% Si, 0.026% Al and 0.026% S, the balance being iron and unavoidable impurities, was transferred to a ladle from the converter in which it was produced. The composition of the slag at the time was 30% CaO, 23% $SiO_2$, 4% $Al_2O_3$ and 43% of other components and no adjustment of this composition was carried out. The ratio of $Al_2O_3$ to $SiO_2$ at this time was 0.17.

The molten steel covered by the slag of the above-mentioned composition was cast into a mold via a tundish to produce 11 continuously cast slabs of a thickness of 200 mm. The slabs were numbered in the same way as those in Example 3.

These slabs were used to produce 0.30 mm thick grain-oriented electrical sheets by the same process as that described in Example 3.

The Al and S content of the eleven slabs and the magnetic characteristics in the longitudinal direction of the grain-oriented electrical sheet products obtained therefrom are shown below in Table 4.

TABLE 4

| Slab No. | 1-5 | 6-7 | 8-9 | 10 | 11 |
|---|---|---|---|---|---|
| Al content of hot rolled sheet | 0.026% | 0.025% | 0.022% | 0.021% | 0.021% |
| S content of hot rolled sheet | 0.026% | 0.025% | 0.023% | 0.022% | 0.022% |

TABLE 4-continued

| Slab No. | 1-5 | 6-7 | 8-9 | 10 | 11 |
|---|---|---|---|---|---|
| B10 of product | 1.93T | 1.92T | 1.87T | 1.85T | 1.85T |
| W17/50 of product | 1.08W/kg | 1.13W/kg | 1.29W/kg | 1.52W/kg | 1.56W/kg |

It will be noted from Table 4 that the products produced from slab Nos. 1-5 displayed good magnetic characteristics but that, since no adjustment was made in the composition of the slag in the manner of the present invention, the Al and S content of the slabs decreased gradually from slab No. 6 onward, with the result that there was a degradation in the magnetic characteristics of the products which became particularly prominent in the grain-oriented electrical sheets produced from the eighth and later slabs.

From the above Examples and comparative Example, it is clear that when the molten steel prepared for continuous casting is covered by slag adjusted in composition in accordance with the present invention, it is possible to produce continuously cast slab which is substantially free from variation in Al content and, if the circumstances so require, also in S content in the direction of casting.

What is claimed is:

1. In a method for continuously casting a slab for manufacturing a grain-oriented electrical steel sheet and strip, the improved method comprising:

(1) transferring molten steel prepared for continuous casting and containing not more than 4.0% of Si, 0.01-0.08% of Al and 0.01-0.06% of S to a ladle or other vessel;

(2) adjusting a slag in said ladle or other vessel, said slag consisting essentially of $SiO_2$, CaO and $Al_2O_3$ on the surface of the molten steel to maintain the ratio of $Al_2O_3$ to $SiO_2$ of the slag at not less than 0.25, and the $Al_2O_3$ to CaO of the slag at not less than 1.0, and (3) continously casting the molten steel.

2. A method according to claim 1, in which the ratio of $Al_2O_3$ to $SiO_2$ of the slag is adjusted in (2) within the range of 0.6 to 3.0.

3. A method according to claim 1, in which the ratio of $Al_2O_3$ to CaO of the slag is adjusted within the range of 1.0 to 2.0.

4. A method according to claim 2, in which the ratio of CaO to $SiO_2$ of the slag is maintained within the range of 0.6 to 2.0.

* * * * *